US005197532A

United States Patent [19]

Cagle

[11] Patent Number: 5,197,532

[45] Date of Patent: Mar. 30, 1993

[54] CYLINDER HEAD CASTING APPARATUS AND METHOD

[75] Inventor: Billy J. Cagle, Indianapolis, Ind.

[73] Assignee: Navistar International Transportation Corp., Chicago, Ill.

[21] Appl. No.: 843,786

[22] Filed: Feb. 28, 1992

Related U.S. Application Data

[62] Division of Ser. No. 490,809, Mar. 7, 1990, Pat. No. 5,119,881.

[51] Int. Cl.[5] ..... B22C 9/10; B22C 9/22

[52] U.S. Cl. ..... 164/137; 164/365; 164/366; 164/367

[58] Field of Search ..... 164/369, 365, 366, 367, 164/137

[56] References Cited

U.S. PATENT DOCUMENTS

| | | | |
|---|---|---|---|
| 246,114 | 8/1881 | Forbes | 164/369 |
| 1,031,305 | 7/1912 | West | 164/367 X |
| 1,717,914 | 6/1929 | Campbell | 164/366 |
| 1,862,975 | 6/1932 | Meloche | 164/366 X |
| 1,899,228 | 2/1933 | Bush, Jr. | 164/367 |
| 1,929,336 | 10/1933 | Stratton | 164/367 |
| 2,268,676 | 1/1942 | Shanley | 164/369 |
| 3,206,811 | 9/1965 | Bellsnyder, Jr. | 164/367 |

FOREIGN PATENT DOCUMENTS

| | | | |
|---|---|---|---|
| 60-76249 | 4/1985 | Japan | 164/366 |

*Primary Examiner*—J. Reed Batten, Jr.
*Attorney, Agent, or Firm*—Dennis K. Sullivan

[57] ABSTRACT

A closed mold for a cylinder head is provided having two widely spaced wall portions, at least one of the widely spaced wall portions being in communication with the atmosphere through an opening in the closed mold. The widely spaced wall portions define the ends of a long open cavity within the mold and provide core supporting portions for a long, narrow core element adapted to form an elongated, narrow open cavity within the casting. A narrow core element is provided between the core supporting portions of the widely spaced wall portions of the mold without intervening support. The long narrow core element comprises an outer portion of casting sand adapted to form the walls of the elongated, narrow open cavity of the casting extending between the core supporting portions. The narrow core element further comprises an inner portion for supporting the long, narrow core element and for providing a gas passage extending to the one wall portion. Molten metal is poured into the closed mold and the long open mold cavity while permitting gas emitted from the casting sand to escape to the atmosphere by carrying the gas to the atmosphere with the inner portion of the long, narrow core element and the opening in the closed mold.

4 Claims, 9 Drawing Sheets

FIG.6B
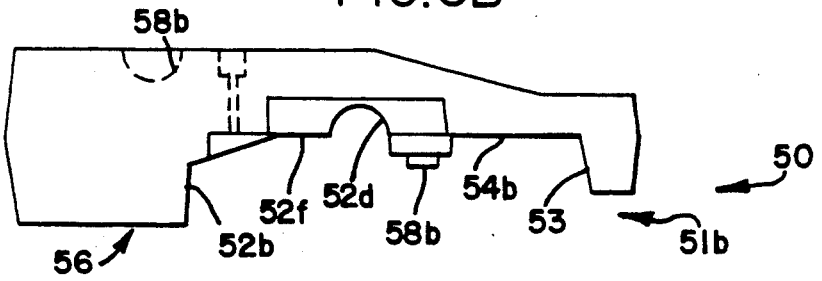
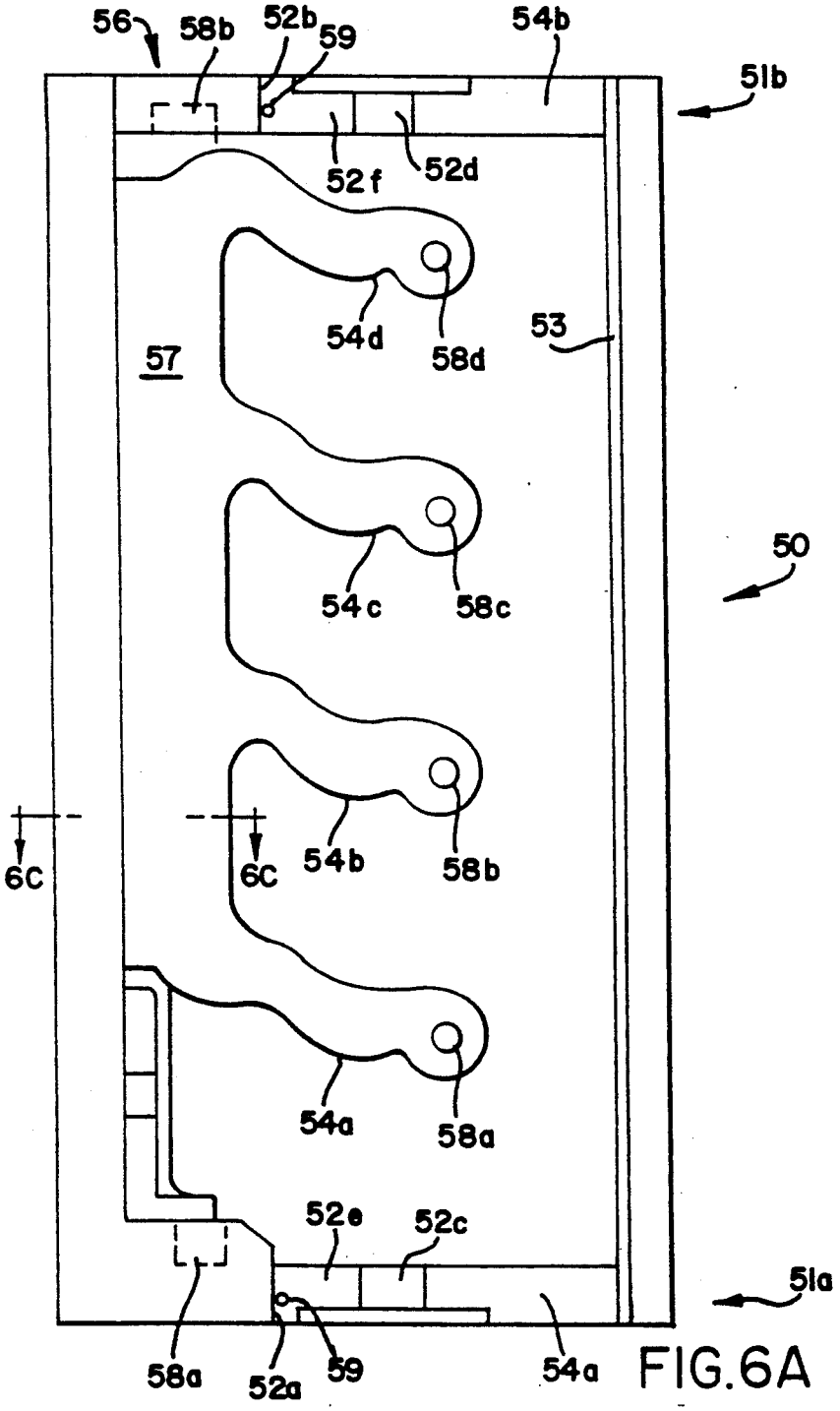
FIG.6A
FIG.6C
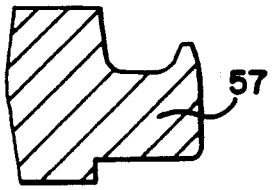

CYLINDER HEAD CASTING APPARATUS AND METHOD

This is a division of application Ser. No. 07/490,809, filed Nov. 7, 1990 and now U.S. Pat. No. 5,119,881.

FIELD OF THE INVENTION

This invention relates to apparatus and methods for casting cylinder heads for internal combustion engines, and more particularly to core assemblies and elements, casting methods employing such core assemblies and elements, and products of such methods and apparatus including cylinder heads for internal combustion engines.

BACKGROUND ART

The manufacture of cylinder heads for internal combustion engines poses difficult manufacturing problems. The cylinder head of an internal combustion engine, whether for a spark driven gasoline internal combustion engine or a compression ignition diesel engine is a complex article of manufacture with many requirements. A cylinder head generally closes the engine cylinders and contains the many fuel explosions that drive the internal combustion engine, provides separate passageways for the air intake to the cylinders and for the engine exhaust, carries the multiplicity of valves needed to control the air intake and engine exhaust, provides a separate passageway for coolant to remove heat from the cylinder head, and provides separate passageways for fuel injectors and the means to operate the fuel injectors.

The walls forming the complex passageways and cavities of a cylinder head must withstand the extreme internal pressures, temperatures and temperature variations generated by the operation of an internal combustion engine, and must be particularly strong in compression-ignition diesel engines. On the other hand, it is desirable that the internal walls of the cylinder head, particularly those walls between coolant passageways and the cylinder closures, permit the effective transfer of heat from the cylinder head, and it is also important that the cylinder head include minimal metal to reduce its weight and cost.

These countervailing requirements make the manufacture of reliable cylinder heads difficult. Furthermore, these complex parts are manufactured by the thousands and assembled into vehicles that must operate reliably under an extreme variety of conditions. The manufacture of reliable cylinder heads is particularly important because of the high cost of their replacement. Consequently, the manufacture of cylinder heads has been the subject of the developmental efforts of engine and automobile manufacturers throughout the world for years.

Cylinder heads are most generally manufactured by casting them from iron alloys. The casting of the cylinder head portion that closes the cylinders, carries the intake and exhaust valves and fuel injectors and provides the passageways for the air intake, exhaust and coolant requires a mold carrying a plurality of core elements. To provide effective cooling of the cylinder head and effective air intake and exhaust from the cylinders of the internal combustion engine, the passageways for the air intake and exhaust are best interlaced with the coolant passageways within the cylinder head portion. The cavities for coolant, air intake and exhaust must, of course, be formed by core elements within the mold that can be removed when the casting metal solidifies.

In prior casting methods where a one-piece coolant jacket core has been used, a plurality of core elements, to form each of the separate passageways for the exhaust and for the air intake, have been manually set into the "green sand" of the mold by workmen. The individual placement by workmen of the core elements forming the intake and exhaust passageways of the cylinder head is necessary in order to interlace the plurality of such core elements with the one-piece coolant jacket-core. In this method, the "green sand" of the mold is provided with preformed cavities to position and hold each of the plurality of separate mold elements that are to form the exhaust passageways and air intake passageways in the cast cylinder head. The "green sand" is a mixture of sand, clay and water which has been pressure-formed into the mold element. Although such green sand provides sufficient structural integrity to contain the molten metal during casting and to form the exterior walls of the casting, it provides no great structural integrity, easily yielding to the pressure that may be exerted by the hands of workmen. Thus, in this manufacturing method, the green sand mold is easily deformed by the workmen in placing any one or more of the plurality of core elements forming the intake and exhaust passageways of the cylinder head in a green sand mold element. The green sand mold is thus incapable of providing and maintaining a reliable location of the plurality of core elements. As the result of such casting methods, there is no assurance that the thickness of the internal walls of the cylinder head will be reliably maintained during manufacture, and there is a substantial risk that unreliable castings will result.

In prior casting methods where a one-piece core formed the plurality of passageways for the air intake to the cylinders and a one-piece core formed the plurality of exhaust passageways from the plurality of cylinders, the coolant passageways are formed with two core elements to permit the interlacing of the portions of the cores forming the air intake passageways and the exhaust passageways with the two core element portions forming the passageways for coolant. In such manufacturing methods, a first element of the coolant core is placed in the green sand mold, and the cores forming the passageways for the air intake and for the engine exhaust are then placed in the green sand mold. The second element of the coolant core is then attached by an adhesive to the first part of the coolant jacket core. This method necessarily requires the use of an adhesive that can be easily spread on the coolant jacket core elements, that will set within the shortest possible time, that will hold the two parts of the coolant jacket core element together as one piece and maintain their position during the casting process, and that may be removed from the casting after the casting metal solidifies. This method results in substantial costs and opportunities for unreliable castings. It is necessary that workmen apply the adhesive correctly so that the adhesive reliably maintains the coolant jacket core elements together during casting. It is also necessary that the workmen reliably assemble the two elements of the coolant jacket core during manufacture. Furthermore, this process requires time for applying the adhesive, assembling the coolant jacket core elements together and allowing the adhesive to set before the mold can be used for casting, and it introduces into the mold an unnecessary foreign element in the form of the adhesive and a potentially unreliable interface between the two elements of the coolant jacket core.

In the casting process, the formation of elongated, narrow, open cavities has not been possible without supporting a long core element forming the elongated open cavity at intervals of several inches throughout the length of the cavity. For example, core elements on the order of 20"-22" in length and about 1" in diameter, cannot be used to form such cavities without a plurality of supports that extend from the core element to adjacent walls of the mold or core and are spaced along the length of the core element between the core element and adjacent walls of the mold assembly. Such long unsupported core elements, because they are less dense than the casting metal and are unsupported, tend to be displaced as the molten metal fills the mold cavities and frequently to fail, for example, by fracturing. Where such long core elements have been used, it has been necessary for the workmen in the factory to place small supporting metal elements, called "chaplets" in the casting art, between such long core elements and the adjoining walls of the mold. Such chaplets prevent the displacement of the long core element as the cavity of the mold fills with molten metal and prevent failure of the long core element, for example, by breaking due to the force imposed upon the core element by the molten metal. The metal chaplets, however, remain in the walls of the casting that form the long open cavity. The metal chaplets are provided with a metallic coating that is intended to fuse with the casting metal at the interface between the chaplet and the casting wall; however, the hands of the workmen placing chaplets into the mold frequently became dirty because of their work in casting operations, and it is practically impossible to keep the surface of the chaplets free of contaminants that interfere with the fusion between the chaplets and the casting walls. Thus, small passageways and other discontinuities in the casting wall can be formed at the interface between such chaplets and the casting metal that makes up the wall for the casting. For many engine manufacturers the most significant warranty expense of an internal combustion engine results from failures and unreliability due to the use of chaplets in supporting core elements within a mold for an internal combustion engine.

Because of the complexity of the cylinder head, past cylinder heads have included more than one part. In addition to the portion of the cylinder head assembly that closes the cylinders, provides the intake, exhaust and coolant passageways, and carries the intake and exhaust valves and fuel injectors, such cylinder head assemblies have included separate castings for the intake manifold and fuel rail. The manufacture of such cylinder head assemblies requires machining of the cylinder head casting, the intake manifold casting and the fuel rail casting to provide sealing surfaces for gaskets, and the labor of their assembly. Such cylinder head assemblies have further possibilities of unreliability because of improper assembly, gasket failure and the like, and impose upon the manufacturer and their dealers a requirement for separate parts inventories.

The aggregate unnecessary costs of such prior casting methods, in the manufacture of the thousands of cylinder heads and in the repair and maintenance of such cylinder head assemblies during their life, is inestimable.

SUMMARY OF THE INVENTION

This invention provides a one-piece cylinder head casting including reliably located passageways for air intake, for exhaust and for coolant and further provides an integral intake manifold and an elongated cavity to provide a reliable reservoir for high pressure hydraulic fluid to operate hydraulically fuel injectors for an internal combustion engine.

The method and apparatus of the invention permit a plurality of interengaging one-piece core elements to form an integral core assembly with interlaced passage-forming portions that are reliably positioned and maintained in position to form a cylinder head with reliably strong walls and with minimal metal content for its operating requirements. A core assembly of the invention includes, for example, a one-piece coolant jacket core, a one-piece exhaust core and a one-piece air intake core, all reliably positioned and held together in an integral core assembly that eliminates unreliable core element assembly and positioning procedures by manufacturing personnel. The method and apparatus of the invention further provide a cylinder head with a long, narrow open cavity formed by uniform walls of casting metal, without foreign elements, to permit the containment of a reservoir of hydraulic fluid at pressures in excess of 3,000 psi.

The invention includes a novel core assembly, as set forth above, for casting cavities in the cylinder head of an internal combustion engine. A preferred core assembly of the invention includes a frame core having a plurality of core supporting and positioning surfaces. The frame core is preferably designed to lighten the cast cylinder head. A one-piece water jacket core is adapted to nest within the frame core. The one-piece water jacket core has a plurality of core supporting and positioning surfaces to engage a plurality of the core supporting and positioning surfaces of the frame core and securely support the one-piece coolant jacket core in position within the frame core. A one-piece exhaust core is also adapted for insertion into the core assembly. The one-piece exhaust core has a plurality of elongated portions for forming exhaust passageways extending through the water jacket core, with supporting portions at the end of the elongated portions engaging some of the plurality of core supporting and positioning surfaces of the frame core. The one-piece exhaust core also has a supporting portion at its periphery engaging a further core supporting and positioning surface of the frame core. A one-piece intake core is adapted to set upon and lock the frame core, the water jacket core, the exhaust core and the intake core into the integral core assembly. The one-piece intake core has a peripheral portion having a surface to engage a core supporting and positioning surface of the frame core and another surface to engage an interfacing surface of the exhaust core. The intake core provides a plurality of elongated portions to form the air intake passageways that extend through the frame core and the water jacket core. The core assembly thereby forms an integral unit with the frame core, water jacket core, exhaust core and intake core being accurately positioned with respect to each other to permit the casting of reliable cylinder heads with accurately positioned internal cavities.

The invention provides an improvement in prior methods of casting with a plurality of mold core elements of an internal engine cylinder head by providing a one-piece water jacket core, a one-piece exhaust core and a one-piece intake core, with said one-piece water jacket core, one-piece exhaust core and one-piece intake core being adapted to provide interlacing passage-forming portions and to be supported and positioned with respect to one another by interengaging interfacing surfaces. Prior methods are further improved by providing a further core element having a plurality of core supporting and positioning surfaces to provide surfaces to mate interfacing surfaces of the one-piece water jacket core, one-piece exhaust core and one-piece intake core and to support such cores in position with respect to one another. Furthermore, the intake core may be provided with a plurality of interfacing surfaces to lock the plurality of core elements into a unitary core assembly.

The method and apparatus of this invention also includes a casting method and apparatus to provide a cylinder head with an elongated, narrow cavity formed with cylinder head walls adapted to contain high hydraulic pressure. The invention permits the casting of elongated, narrow, open cavities, having lengths many times their widths, by providing a closed mold having two widely spaced wall portions, at least one of which is in communication with the atmosphere through the closed mold. The widely spaced wall portions define the ends of a long, narrow open mold cavity within the mold and provide core supporting portions for a long core element, having a length many times its width, adapted to form the long, narrow cavity within the walls of the casting. The long core element extends between the core supporting portions of the widely spaced wall portions of the mold without any intervening support. The long core element includes an outer portion of casting sand that extends between the core supporting portions and is adapted to form the walls of the long, narrow cavity. The long core element further includes an inner supporting portion for the casting sand that also extends between the core supporting portions of the widely spaced walls. The inner supporting portion of the long core element is adapted to permit gas to escape to atmosphere through the long core element during casting. Preferably, the inner supporting portion of the long core element comprises a perforated tube. In casting, gas emitted from the casting sand as molten metal is poured into the closed mold and the cavity within the mold surrounding the long core element is carried to atmosphere with the inner supporting portion of the long core element.

A cylinder head casting of the invention resulting from the above methods and apparatus can include a long cylinder block closing portion adapted to close and provide fuel and air intake to and an exhaust from a plurality of cylinders formed in the block of an internal combustion engine. The cylinder block closing portion can be provided with a plurality of spaced head portions adapted to engage an engine block and to close the plurality of cylinders of the engine block. The cylinder block closing portion of the cylinder head can also form a plurality of air intake passage-forming portions transversing the long cylinder block closing portion and communicating with the plurality of spaced head portions. In the invention, the cylinder head can be provided with a side portion forming a long, open air-intake manifold cavity extending the length of the cylinder head casting between the plurality of transverse intake passage-forming portions and the side of the cylinder head casting. Furthermore, in the invention the cylinder head can be provided with a fluid reservoir cavity adapted to contain high hydraulic pressure extending longitudinally in the cylinder head casting.

Further features and advantages of the invention will be apparent from the drawings and description of the best mode and preferred embodiments of the invention which follow.

BRIEF DESCRIPTION OF THE DRAWINGS

FIG. 6A is a plan view taken from below the intake core of the core assembly of FIG. 1A;

FIG. 6B is an end view of the intake core of FIG. 6A;

FIG. 6C is a cross-section of the intake core of FIG. 6A taken along a plane indicated by line 6C—6C of FIG. 6A;

BEST MODE OF THE INVENTION

Figure 7:
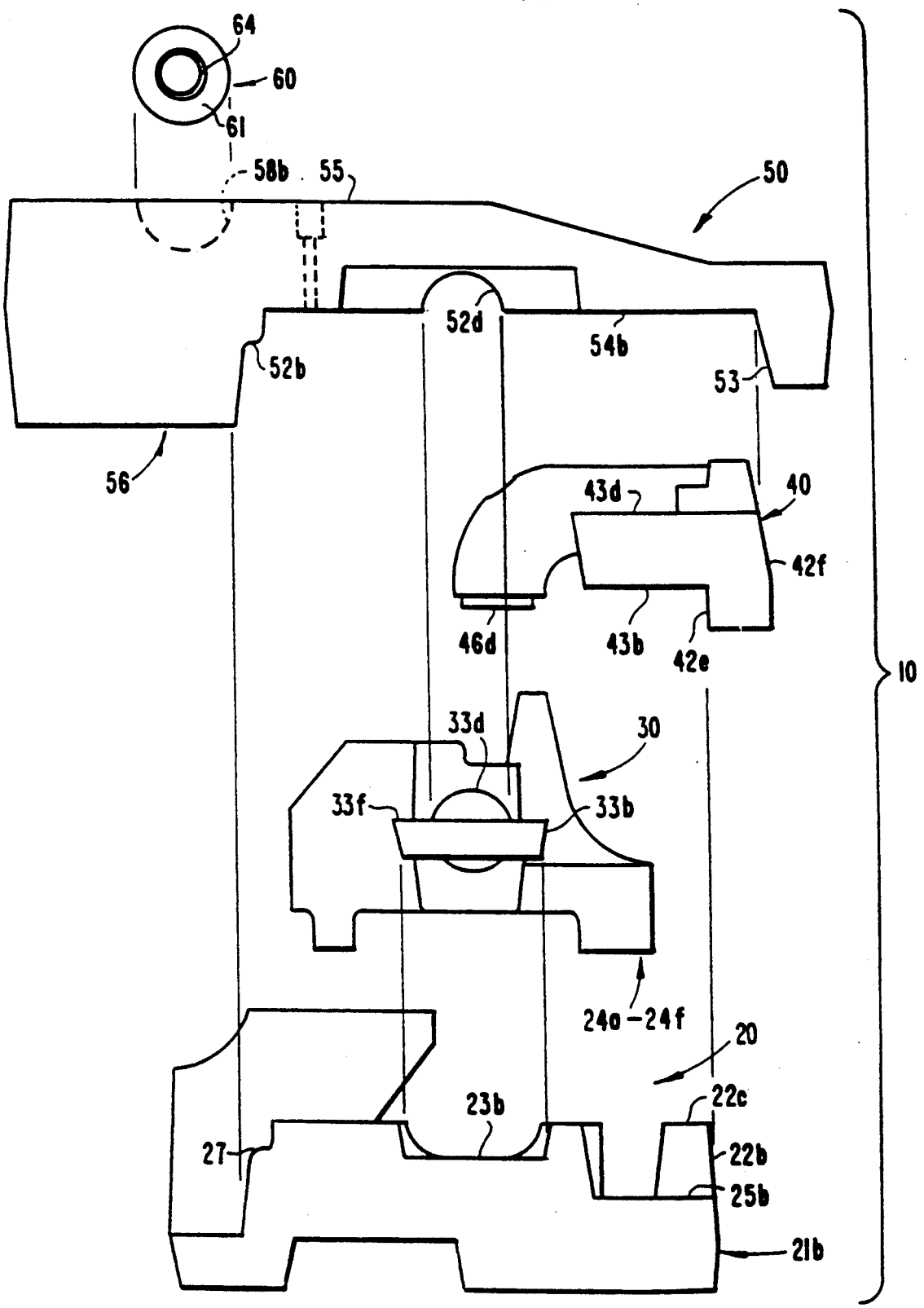
FIG. 7 is an exploded end view of the core assembly of FIG. 1A showing the individual core elements shown in FIGS. 3–6.

FIGS. 1–7 illustrate a preferred method and apparatus of this invention which permit a plurality of interengaging one-piece core elements, shown in FIGS. 3–6, to form an integral core assembly, shown in FIGS. 1 and 2, with interlaced passage-forming portions that are reliably positioned and maintained in position to form a cylinder head having reliably strong walls with minimal metal content. A core assembly of the invention includes, for example, a one-piece coolant jacket core like that shown in FIG. 4, a one-piece exhaust core like that shown in FIG. 5, and a one-piece air intake core like that shown in FIG. 6, that can be easily and reliably positioned with respect to one another by manufacturing personnel through their interengaging core supporting and positioning surfaces, as further described below. Preferred core assemblies of the invention include a frame core like that shown in FIG. 3, which can be provided with a plurality of surfaces to support and position one-piece coolant jacket, exhaust and intake cores. Such a frame core is also preferably designed to include thickened interconnecting webs and a plurality of projecting portions to lighten the cast cylinder head. FIG. 7 is an exploded end view of a preferred core assembly of the invention to illustrate how the one-piece frame core, one-piece coolant jacket core, one-piece exhaust core and one-piece intake core are assembled into the core assembly illustrated in FIGS. 1 and 2.

Figure 1A:
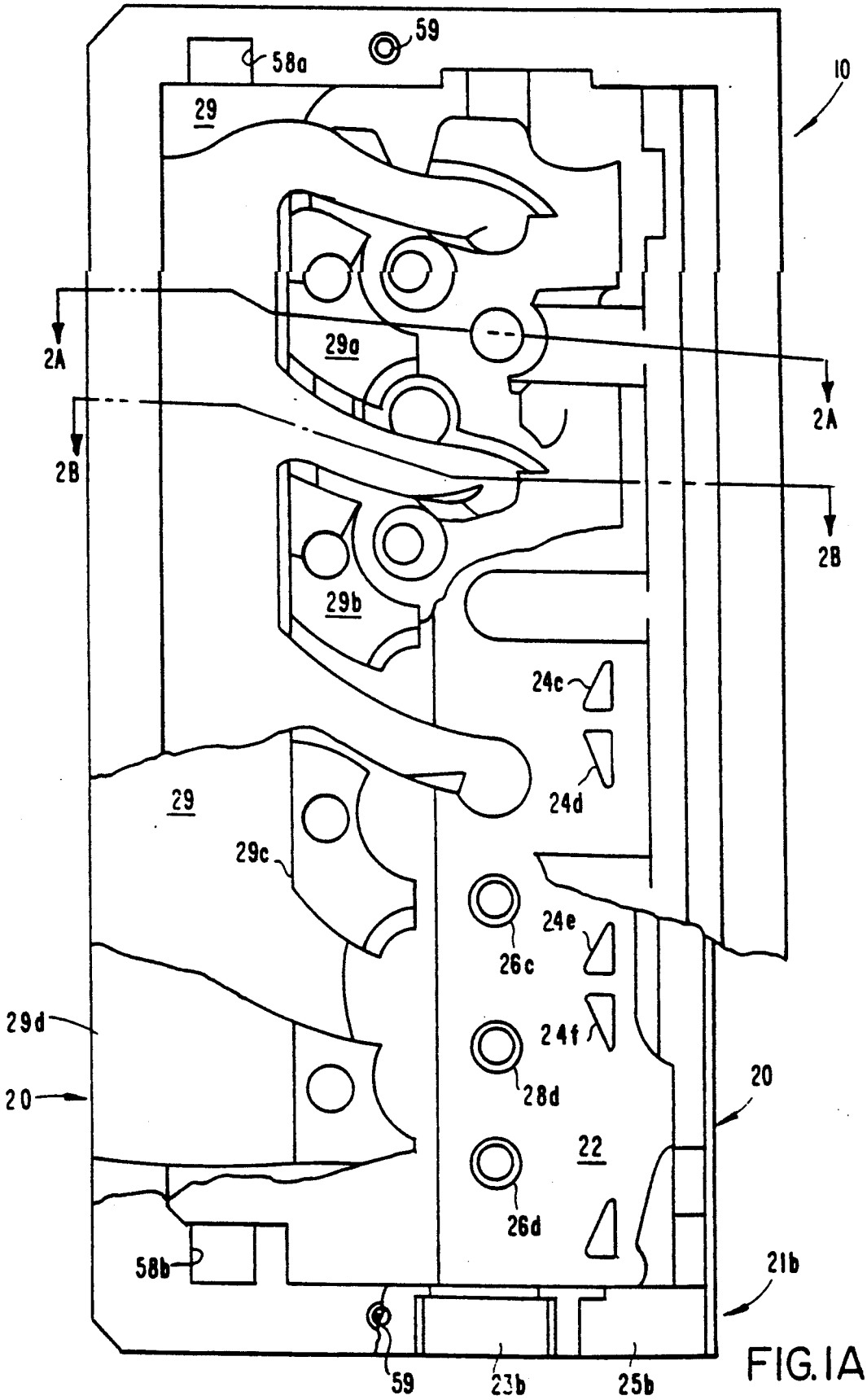
FIG. 1A is a plan view taken from above a preferred core assembly of the invention with portions of the various core elements broken away.

FIG. 1A shows a plan view of a core assembly 10 of this invention with portions of the core elements that make up the core assembly broken away. Because the passage-forming portions of the various core elements have very complex three-dimensional configurations which interlace and include portions overlying one another in the core assembly, the invention may be more easily understood by referring to the drawings of individual core elements, FIGS. 3-6, FIG. 2A (the cross-section taken at line 2A—2A of FIG. 1A through an elongated exhaust-forming portion of the exhaust core), FIG. 2B (the cross-section taken at line 2B—2B of FIG. 1A through the center of an elongated intake forming portion of the intake core 50) and FIG. 7, which is an exploded view of the core assembly 10, showing the individual core elements 20, 30, 40, 50.

Figure 3A:
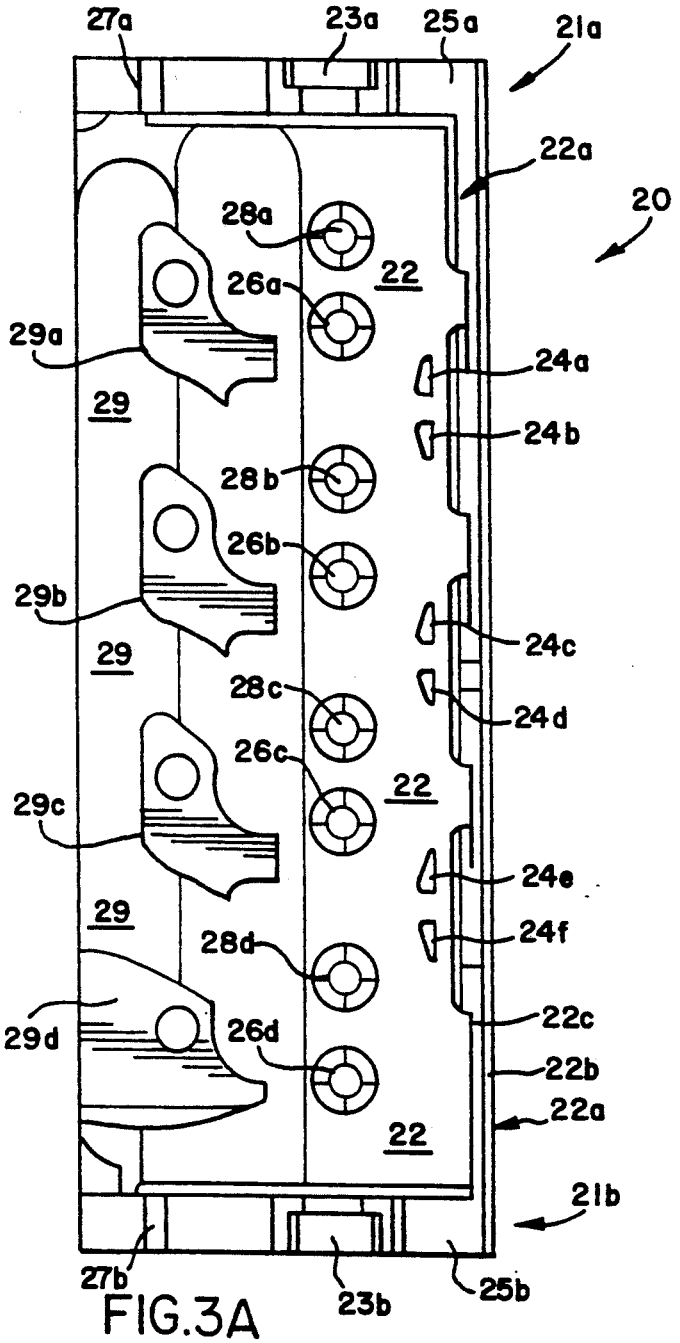
FIG. 3A is a plan view taken from above the frame core of the core assembly of FIG. 1A.
Figure 3C:
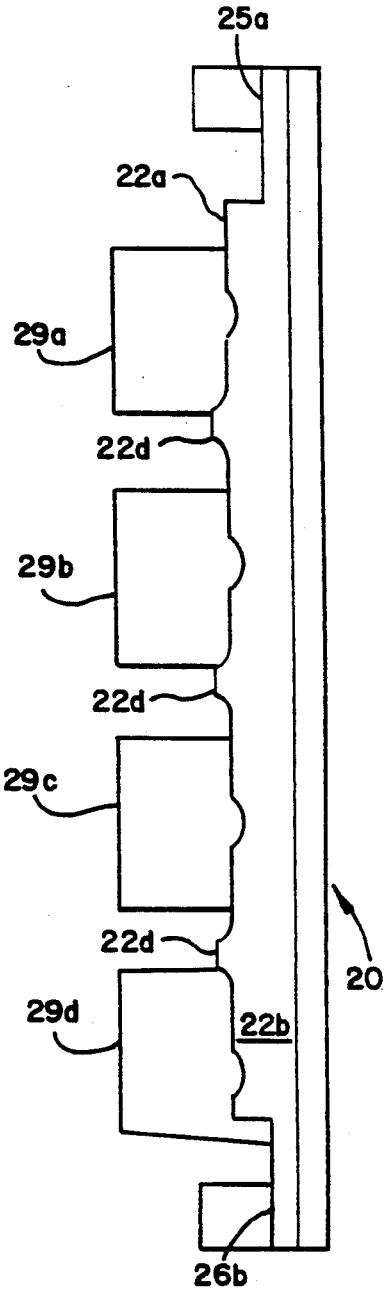
FIG. 3C is a side view of the frame core of FIG. 3A.
Figure 3B:
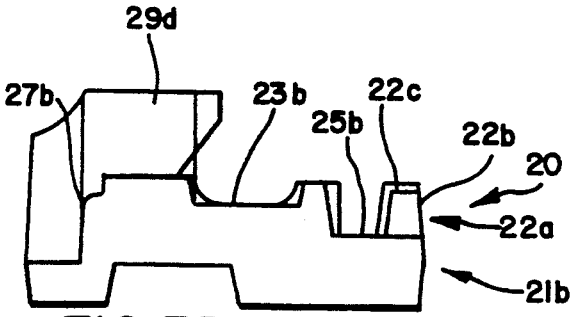
FIG. 3B is an end view of the frame core of FIG. 3A.

FIGS. 3A and 3B show a frame core 20 of a preferred embodiment of the invention. Frame core 20 includes a plurality of supporting and positioning surfaces for the coolant jacket core 30, the exhaust core 40 and the air intake core 50. The frame core 20 comprises two end portions 21*a* and 21*b* interconnected by an elongated web 22. The ends 21*a* and 21*b* form core supporting and positioning surfaces 23*a* and 23*b*, respectively, for the coolant jacket core 30, and web 22 forms a plurality of recesses 24*a*-24*f* which also support and position the coolant jacket core 30.

Frame core 20 includes a further plurality of core supporting and positioning surfaces for the exhaust core 40. As shown in FIGS. 3A and 3B, the two end portions 21*a* and 21*b* of frame core 20 form core supporting and positioning surfaces 25*a* and 25*b*, respectively, for the exhaust core 40. In addition, the interconnecting web 22 includes a further plurality of core supporting and positioning recesses 26*a*-26*d* for the ends of the elongated exhaust forming portions of exhaust core 40.

Frame core 20 also includes a plurality of core supporting and positioning surfaces for the air intake core 50. As shown in FIGS. 3A and 3B, the ends 21*a* and 21*b* of frame core 20 form core supporting and positioning surfaces 27*a* and 27*b* respectively for the air intake core 50. The interconnecting web 22 also forms a plurality of core supporting and positioning recesses 28*a*-28*d* for the ends of the elongated intake-forming portions of the air intake core 50.

In the preferred embodiment shown in FIGS. 3A and 3B, the interconnecting web 22 of frame core 20 includes an orthogonal web portion 22*a* extending upward from web 22 between ends 21*a* and 21*b* respectively. The orthogonal web 22*a* is formed with a ramp-like inclining rear surface 22*b* and has a keyed top surface 22*c*, as shown in FIG. 3C, to provide further core supporting and positioning surfaces for exhaust core 40. The keyed top surface 22*c* has a plurality of projecting portions 22*d* to engage and position the exhaust core 40.

As indicated above, it is desirable that a cylinder head be cast with a minimal amount of metal to reduce its cost and to save vehicle weight for better fuel economy. Accordingly, the ends 21*a* and 21*b* and the interconnecting web 22 may be provided with thickened portions that are larger than necessary to support the core elements of core assembly 10 to increase the volume of the cavities formed within the cylinder head casting and reduce the weight of the casting. As shown in FIGS. 3A and 3B, a preferred frame core 20 includes further web 29 providing a plurality of projecting portions 29*a*-29*d* that extend between the elongated intake forming portions of the air intake core 5, as shown in FIG. 1A, to substantially reduce the weight of the casting.

The frame core 20 can be seen in the bottom portion of the FIG. 1A plan view of core assembly 10. In the bottom portion of FIG. 1A, the coolant jacket core 30, exhaust core 40 and intake core 50 have all been broken away to expose end 21*b* of frame core 20, the core supporting and positioning surface 23*b* for the coolant jacket core, the core supporting and positioning surface 25*b* for the exhaust core 40, the core supporting and positioning surfaces 24*c*, 24*d*, 24*e* and 24*f* for the coolant jacket core 30, the core supporting and positioning surfaces 26*c* and 26*d* for the elongated exhaust-forming portions of exhaust core 40, the core supporting and positioning surface 28*d* for the elongated intake-forming portion of the air intake core 50 and to more clearly show the lower portion of web 29 and the projecting core-lightening portions 29*c* and 29*d* of frame core 20.

Figure 4A:
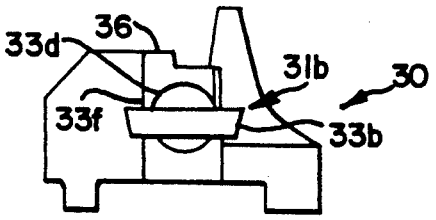
FIG. 4A is a plan view taken from below the coolant jacket core of the core assembly of FIG. 1A.
Figure 4B:
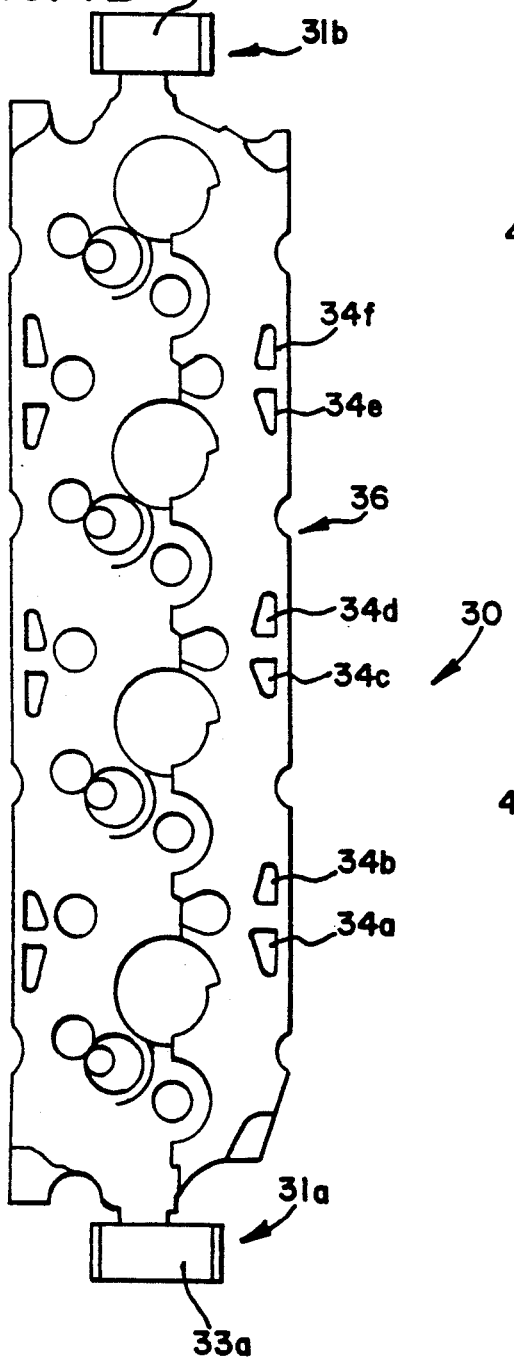
FIG. 4B is an end view of the coolant jacket core of FIG. 4A.

FIGS. 4A and 4B show a one-piece coolant jacket core 30 of the core assembly of this invention. FIG. 3A is a plan view of frame core 20 taken from above frame core 20 as it is normally placed in the manufacture of core assembly 10 in order to illustrate the plurality of core supporting and positioning surfaces and lightening portions of frame assembly 20. In order to show the interengaging core supporting and positioning surfaces of the coolant jacket core 30, FIG. 4A is a plan view taken from below the coolant jacket core as it is normally positioned for assembly onto frame core 20.

As shown in FIG. 4A, coolant jacket core 30 includes two ends 31*a* and 31*b* forming core supporting and positioning surfaces 33*a* and 33*b*, respectively, that engage the core supporting surfaces 23*a* and 23*b*, respectively, of frame core 20 to support and position coolant jacket core 30 on frame core 20. As shown in FIGS. 4A and 4B, the underside of coolant jacket core 30 forms a further plurality of core supporting and positioning surfaces in the form of a plurality of projecting feet 34*a*-34*f*. As shown in FIG. 4A and in FIG. 3A, the projecting feet 34*a*-34*f* of coolant jacket core 30 and the core supporting and positioning recesses 24*a*-24*f* on the upper surface of the interconnecting web 22 of frame core 20 are shaped so that coolant jacket core 30 will be positioned and supported by the engagement of feet 34*a*-34*f* with recesses 24*a*-24*f* when the coolant jacket core 30 is placed upon frame core 20.

Figure 2A:
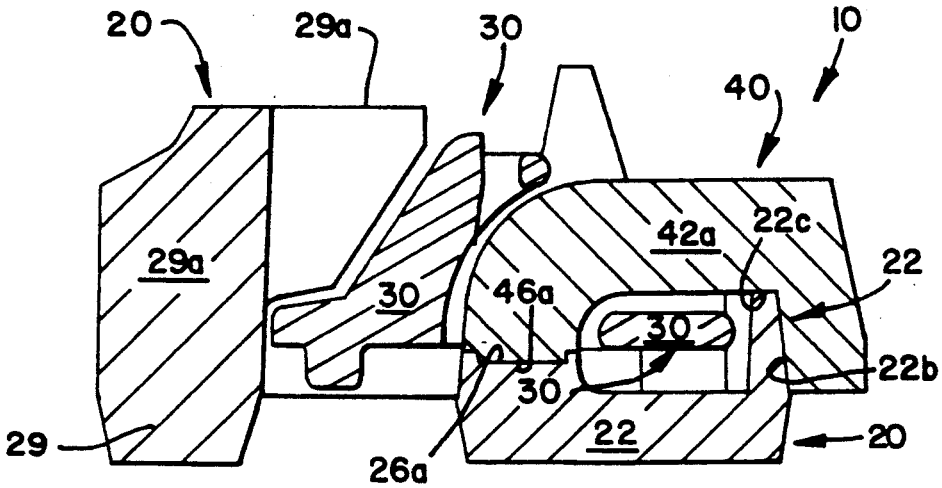
FIG. 2A is a cross-section of the core assembly of FIG. 1A taken along a plane indicated by line 2A—2A of FIG. 1A.
Figure 2B:
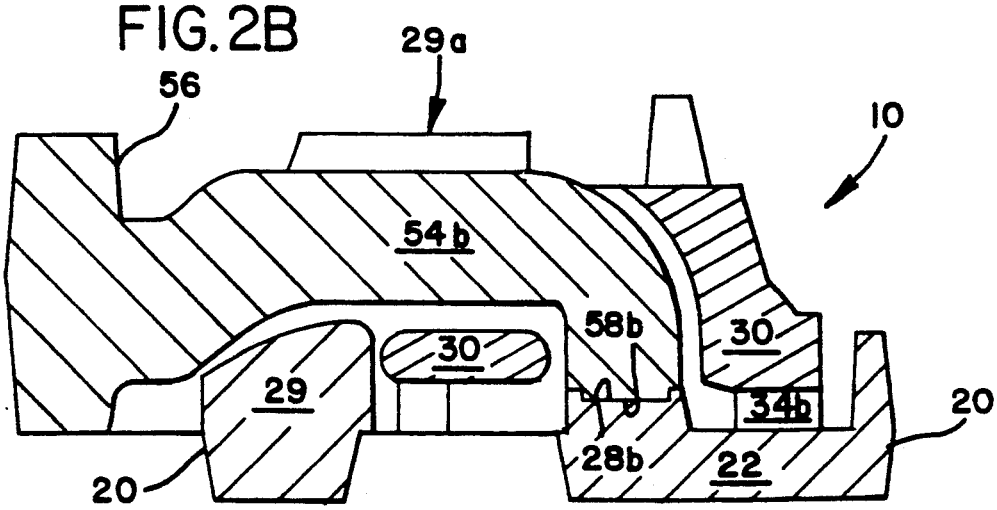
FIG. 2B is a cross-section of the core assembly of FIG. 1A taken along a plane indicated by line 2B—2B of FIG. 1A.

As indicated in the drawing, the central portion 36 of coolant jacket core 30 is complexly shaped and includes portions that both underlie and overlie the exhaust core 40 and the intake core 50 when the core elements are assembled into core assembly 10. As shown, for example, in FIG. 2A, a cross-section of the core assembly taken along line 2A—2A of FIG. 1A, the coolant jacket core 30 both underlies and overlies exhaust core 40, and the exhaust passage-forming portion of the core assembly is interlaced with the coolant passage-forming portion of the assembly. As shown in FIG. 2B, the one-piece coolant jacket core includes portions underlying and portions overlying the intake passage-forming portion of the air intake core 50, and the air intake passage-forming portion of the core assembly is interlaced with the coolant passage-forming portion of the core assembly.

Figure 5B:
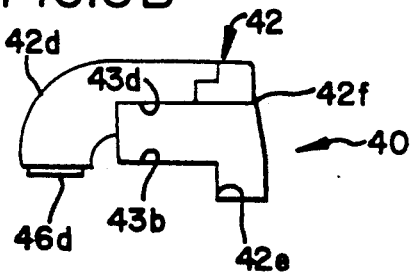
FIG. 5B is an end view of the exhaust core of FIG. 5A.
Figure 5A:
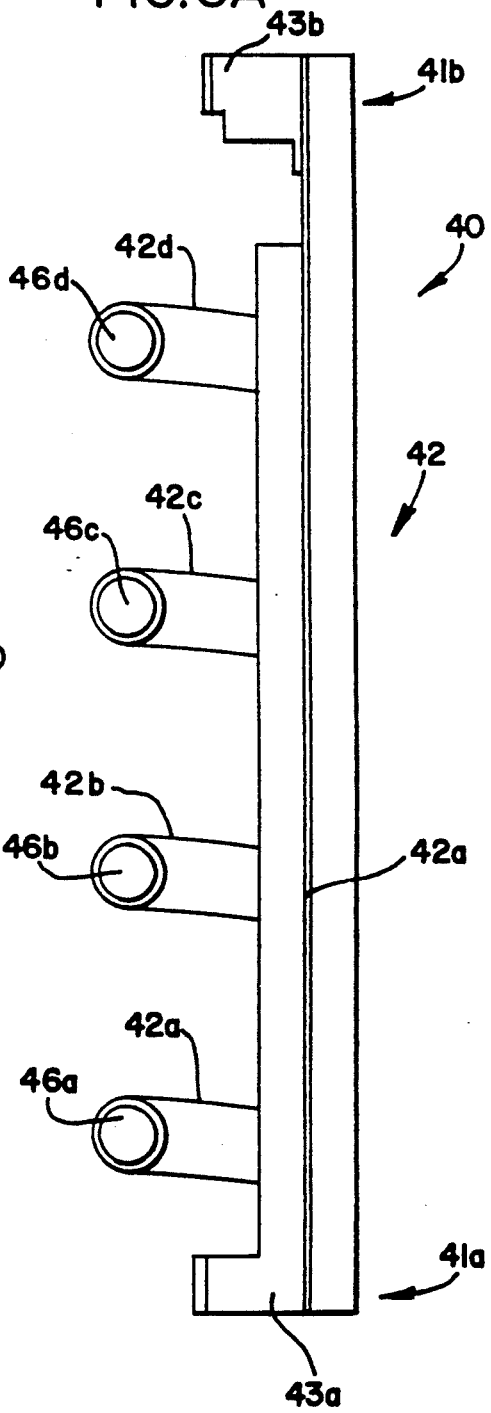
FIG. 5A is a plan view taken from below the exhaust core of the core assembly of FIG. 1A.

FIGS. 5A and 5B show an exhaust core of the core assembly of the invention. Like FIG. 4A, FIG. 5A is a plan view taken from below the exhaust core as it is normally placed into engagement with the frame core 20. FIG. 5A thus better illustrates the core supporting and positioning surfaces of the exhaust core.

Figure 1B:
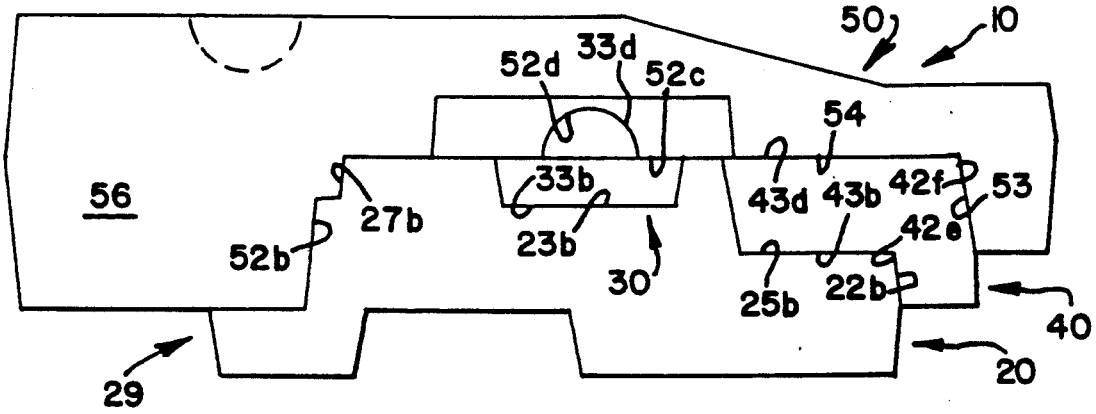
FIG. 1B is an end view of the core assembly of FIG. 1A.

As shown in FIG. 5A, exhaust core 40 has two end portions 41*a* and 41*b* which form core supporting and positioning surfaces 43*a* and 43*b*, respectively. Core supporting and positioning surfaces 43*a* and 43*b* of exhaust core 40 engage the core supporting surfaces 25*a* and 25*b*, respectively, of frame core 20, as indicated in FIGS. 1B and 7. As shown in FIG. 5A, ends 41*a* and 41*b* of exhaust core 40 are interconnected by an elongated web 42 which supports a plurality of elongated exhaust passage-forming portions 42*a*–42*d*, and core supporting and positioning surfaces are formed at the ends of the elongated exhaust passage forming portions of exhaust core 40. As shown in FIG. 5A, core supporting and positioning surfaces 46*a*–46*d* are formed at the ends of the exhaust passage forming portions 42*a*–42*d*, respectively. Core supporting and positioning surfaces 46*a*–46*d* of exhaust core 40 engage core supporting and positioning surfaces 26*a*–26*d*, respectively, of frame core 20. FIG. 2A taken through the center of the exhaust passage-forming portion 42*a* of exhaust core 40 shows the engagement of core supporting and positioning surface 46*a* of exhaust core 40 with a corresponding core supporting and positioning surface 26*a* of frame core 20. As shown in FIGS. 2B, 5B and 7, the interior surface 42*e* of web 42 is formed with an inclined surface that engages the inclined surface 22*b* of frame core 20 and provides further support and positioning of exhaust core 40 on frame core 20. The outside surface of web 42 of exhaust core 40 also includes a inclined surface 42*f* as shown in FIG. 5B which provides, as will be explained, a core supporting and positioning surface for the air intake core 50. Finally, the upper surfaces 43*c* (not shown) and 43*d* (FIG. 5B) of ends 41*a* and 41*b*, respectively, provide further core supporting surfaces for the air intake core 50 as shown in FIG. 1B.

FIGS. 6A and 6B illustrate an air intake core of the core assembly of this invention. In this preferred embodiment, the intake core 50 is one piece and is adapted to sit upon and lock the frame core, coolant jacket core, exhaust core and intake core into an integral core assembly. In locking the other core elements into an integral core assembly, the intake core has a first portion (52*a*, 52*b*) engaging at least a core supporting and position surface of the frame core, a second portion (53) engaging an interfacing surface of the exhaust core and a third portion (52*c*, 52*d*) engaging an interfacing surface of the coolant jacket core, and the first, second and third portions of the intake core are adapted to lock the frame core, coolant jacket core and exhaust core, together with the intake core, into an integral assembly.

As shown in FIG. 6A, the one-piece intake core 50 includes two end portions 51*a* and 51*b*. As shown in FIG. 1B and FIG. 7, the end portions comprise a first portion 52*a*, 52*b* engaging core supporting and positioning surfaces 27*a* and 27*b* of frame core 20. The end portions 51*a* and 51*b* further comprise a second portion 52*c*, 52*d* that engage core supporting and positioning surfaces 33*c* and 33*d* of coolant jacket core 30, and the intake core 50 further comprises a third portion 53 formed as an inclined surface and engaging the interfacing inclined outside surface 42*f* of exhaust core 40. As indicated in FIG. 5A, intake core 50 forms a plurality of elongated intake-forming portions 54*a*–54*d* that form the air intake passageways for the cylinder head. The ends of the elongated intake-forming portions 54*a*–54*d* include core supporting and positioning surfaces 58*a*–58*d*, respectively. The core supporting and positioning surfaces 58*a*–58*d* of intake core 50 engage the core supporting and positioning surfaces 28*a*–28*d*, respectively, of frame core 20, which are shown in FIG. 3A. FIG. 2B which is a cross-sectional view of FIG. 1A taken through the center of the elongated intake passage forming portion 54*b* of intake core 50 shows the manner in which core supporting and positioning surface 58*b*, for example, engages the corresponding core supporting and positioning surface 28*b* of frame core 20.

As indicated in FIG. 1B, the first portion 52*b* of core element 50 is slightly inclined from perpendicular, as is surface 27*b* of frame core 20, and has a slightly inclined engagement with core supporting and positioning surface 27*b* of frame core 20. The third portion 53 of intake core 50 is also slightly inclined from perpendicular as is surface 47*f* of exhaust core 40. The plane of third portion 53 lies at an acute angle with respect to the plane of first portion 52*d*, and the weight of intake core 50 exerts through the first portion 52*b* and third portion 53 inwardly directed forces that, along with the trapping effect of the second portion 52*d*, lock the core elements into an integral core assembly.

Core assembly 10 thus includes a one-piece coolant jacket core, a one-piece exhaust core and a one-piece intake core that form an integral core assembly with interlaced portions to form passageways for coolant, air intake and exhaust gas of an internal combustion engine.

In the core assembly 10, the one-piece coolant jacket core 30 is adapted to nest within the frame core 20 with its plurality of core supporting and positioning portions (33*a*, 33*b*, 34*a*–34*f*) engaging a plurality of the core supporting and positioning portions (23*a*, 23*b*, 24*a*–24*f*) of the frame core 20 to support and position the one-piece coolant jacket core within the assembly. The one-piece exhaust core 40 is also positioned and supported in the assembly with its plurality of elongated exhaust-forming portions (42*a*–42*d*) extending through the coolant jacket core 30. The ends of the elongated portions (42*a*–42*d*) are provided with core supporting and positioning surfaces (46*a*–46*d*) engaging some (26*a*–26*d*) of the plurality of core supporting and positioning portions of the frame core. The one-piece exhaust core also has a peripheral supporting portion (42*e*, 43*a*, 43*b*) engaging a core supporting and positioning portion (22*b*, 25*a*, 25*b*) of the frame core. The one-piece intake core 50 is adapted to sit on and lock the frame core 20, coolant jacket core 30 and exhaust core 40 into an integral core assembly. The one-piece intake core has a first portion (52*a*, 52*b*) engaging a core supporting and positioning portion (27*a*, 27*b*) of the frame core, a second portion (52*c*, 52*d*) engaging a core supporting and positioning portion (33*c*, 33*d*) of the coolant jacket core and a third portion (53) engaging an interfacing portion (42*f*) of the exhaust core. The first and third portions, engaging respectively the frame core and exhaust core, form inclined surfaces (52*a*, 52*b*, 53) that lock the exhaust core 40 and the coolant jacket core 30 into the assembly. Thus, the core assembly 10 is an integral unit with the core elements forming the coolant jacket core, the exhaust core and air intake core being accurately positioned with respect to one another, thereby permitting the casting of cylinder heads with accurately maintained internal wall thicknesses.

In casting a cylinder head with a method of the invention, I am able to provide a one-piece coolant jacket core 30 having a plurality of core supporting and positioning surfaces. I also provide a frame core 20 having a plurality of supporting and positioning surfaces, and I support and position the one-piece coolant jacket core 30 on the frame core by engaging a plurality of the corresponding core supporting and positioning surfaces of the coolant jacket core and the frame core. As shown in FIG. 7 with the preferred embodiment, the coolant jacket core 30 may be lowered into the frame core 20 with supporting and positioning surfaces 33*a* and 33*b* of the one-piece coolant jacket core engaging supporting and positioning surfaces 23*a* and 23*b* as the coolant jacket core is so positioned, and with its core supporting and positioning feet 34*a*–34*f* engaging the corresponding core supporting and positioning surfaces 24*a*–24*f* of the frame core. I then provide a one-piece exhaust core 40 having a plurality of exhaust passageway-forming portions 42*a*–42*d* with a plurality of core supporting portions 46*a*–46*d* in the assembly of this invention. I insert the one-piece exhaust core 40 into the assembled frame core and coolant jacket core by extending the elongated exhaust passage-forming portions 46*a*–46*d*, which project transversely outwardly from the exhaust core, through openings in the coolant jacket core (see FIGS. 1 and 2), and I support and position the exhaust core 40 in the assembly by engaging the plurality of corresponding core supporting and engaging surfaces of the exhaust core (42*e*, 43*a*, 43*b*, 46*a*–46*d*) and the frame core (22*b*, 25*a*, 25*b*, 26*a*–26*d*). By providing an intake core 50 having a plurality of core supporting and positioning surfaces adapted to engage the frame core, the coolant jacket core and the exhaust core, I am able to provide a core assembly with the core elements locked together as an integral unit. The intake core 50 provides a plurality of air intake passage-forming portions 54*a*–54*d* that extend transversely outwardly from the frame, and I place the intake core 50 on the assembled frame core 20, coolant jacket core 30 and exhaust core 40 with a plurality of core supporting and positioning surfaces (52*a*–52*f*, 53, 54*a*, 54*b*) engaging the corresponding core supporting and positioning surfaces of the frame core (27*a*–27*f*), coolant jacket core (33*c*–33*f*) and exhaust core (42*f*, 43*c*, 43*d*) locking the core elements, by their engagement, into an integral unit. As indicated in FIGS. 1A and 1B, I may provide the intake core and frame core with bores 59*c* and 59*d* for a threaded fastener such as a long machine screw. In the invention, however, the core elements of the core assembly are sufficiently locked together that the core assembly may be moved about without such fasteners and without fear of displacing any of the passage cavity-forming elements of the core assembly. FIG. 7 indicates, in its exploded view, the manner in which the core elements of my invention are assembled.

While the preferred embodiment of core assembly of the invention described above includes frame core with a plurality of core supporting and positioning surfaces, the assembly of a one-piece coolant jacket core, a one-piece exhaust core and a one-piece intake core into an integral assembly with interlaced passage-forming portions can be achieved without such a frame core. The manner in which intake core 50 can support and position exhaust core 40 and coolant jacket core 30 in an integral assembly without frame core 20 can be understood by considering an inverted version of FIG. 1B and an inverted version of FIG. 7.

Such an integral core assembly can, for example, be made by inverting the intake core 50 and using its plurality of core supporting and positioning surfaces to support and position the exhaust core and coolant jacket core. The inverted intake core 50 will rest stably on its large planar surface 55. Coolant jacket core 30 is inverted for assembly onto the inverted intake core 50, is positioned and supported on intake core 50 by placing its core supporting and positioning surfaces 33*d* and 33*f* at end 31*b* and corresponding surfaces 33*c* and 33*e* at end 31*a* (not shown) into engagement with core supporting and positioning surfaces 52*d* and 52*f* at end 51*b* and surfaces 52*c* and 52*e* at end 51*a* of the inverted intake core 50. Intake core 50 will also position and support exhaust core 40 by its inclined surface 53 at the periphery of intake core 50 and surfaces 54*a* and 54*b* of ends 51*a* and 51*b*, respectively. Exhaust core 40 is inverted and rotated into position on the inverted intake core 50, which will support stably the weight of the exhaust core 40 by virtue of its heavy side portion 56. Inverted exhaust core 40 is positioned on the inverted intake core 50 by engaging surface 43*d* at 41*b* and the corresponding surface 43*c* (not shown) at end portion 41*a* at 41*b* and surface 42*f*, with surfaces 54*b* and 54*a* of end portions 51*b* and 51*a*, respectively, and surface 53 of intake core 50. Note that the inclined surfaces 42*f* and 53 permit exhaust core 40 to be rotated about its longitudinal axis for assembly with the assembled intake core and coolant jacket core.

It will be apparent to those skilled in the art that the core elements may be varied in their design from cylinder head to cylinder head and for combustion-ignition diesel engines and gasoline engines and that the various core elements may be provided with core supporting and positioning surfaces at locations different than those shown on the specific embodiments shown and described above. It will be also apparent to those skilled n the art that if an integral core assembly is to be made with a one-piece coolant jacket core, one-piece exhaust core and one-piece intake core, the intake core may serve as a frame as described above and be provided with further surfaces and portions to support and position the exhaust core and coolant jacket core thereon during assembly, and such an assembly may be provided with fastening means, if necessary, for handling. Such fastening means are not necessary, however, since the inverted core assembly may be placed in an inverted upper half of a green sand mold and a lower half mold half can be inverted and assembled thereon.

As indicated above, the invention further provides an integral intake manifold. Such an integral intake manifold is formed in the core assembly of this invention by providing the intake core 50 with an intake manifold forming portion 57 from which the air intake passage-forming portions 54*a*–54*d* extend. As shown in FIG. 6A, intake manifold-forming portion 57 extends inwardly from the periphery of the intake core 50 between intake passage-forming portion 54*a* and intake passage-forming portion 54*d*. The cross-section of the intake manifold-forming portion 57 which, of course, indicates the cross-sectional shape of the intake manifold cavity, is shown in the partial cross-section FIG. 6C. When a cylinder head is cast including a core assembly with an intake manifold-forming portion such as portion 57 of the intake manifold 50 shown in FIGS. 6A–6C, the side portion of the cast cylinder head will include a air intake manifold cavity extending longitudinally in and opening outwardly from the side portion of the cylinder head casting, and a plurality of air intake passageways will extend transversely inwardly from the intake manifold cavity to the cylinder closing portions of the cylinder head.

As indicated above, this invention also provides method and apparatus for the formation of castings with elongated, narrow cavities formed with uniform and uninterrupted walls of casting metal, such method and apparatus can provide a cast cylinder head with a reservoir for hydraulic fluid at high hydraulic pressure.

Figure 8:
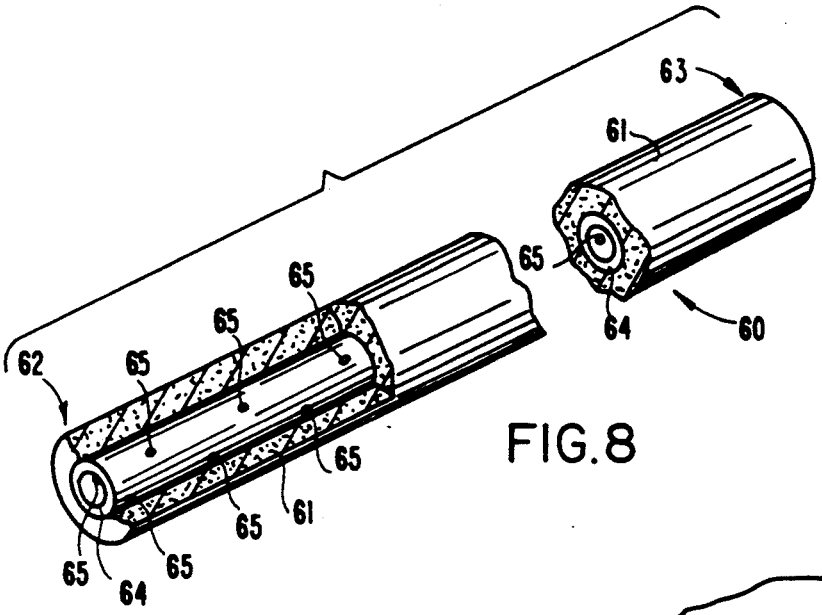
FIG. 8 is a partially broken-away perspective view of a long core element of this invention.

In the invention, an elongated, narrow open cavity formed by walls that will contain high hydraulic pressures on the order of 3,000 p.s.i. may be formed by a single long core element, a preferred embodiment of which is shown in FIG. 8. As shown in FIG. 8, a core element 60 that is about 22 inches long and about 1¼ inches in diameter includes an outer portion 61 that is formed from casting sand and is adapted to form the interior walls of a long open cavity of a casting. Where the long open cavity is to be used as a reservoir for hydraulic fluid at high hydraulic pressure, a preferred cross-section for the outer portion 61 of casting sand is circular to provide round continuous internal walls of the hydraulic fluid reservoir. In forming a long open cavity, the long, narrow core element 60 is supported only adjacent its ends 62 and 63, respectively, and core element 60 includes an inner supporting portion 64 that extends between ends 62 and 63 and supports the wall forming portion 61 during casting. The inner supporting portion 64 is adapted to permit gas to escape to atmosphere through the long core element 60 during casting. As shown in FIG. 8, the inner supporting portion can comprise a long tube which is provided with a plurality of perforations 65. While a currently preferred inner supporting element 64 comprises a perforated metal tube, other inner supporting elements may be used in the long core element 60. It is necessary that the inner supporting element 64 provide sufficient mechanical rigidity to resist a deformation of long core element 60 between ends 62 and 63 during casting and that the inner supporting element 64 form an escape path for gasses emitted from the mold sand during casting. Examples of other such inner supporting elements include threaded rod stock, or a rod which has been provided with longitudinal grooves.

In the preferred core assembly 10 of this invention shown in FIGS. 1–7, such a long core element 60 may be supported by the intake manifold 50 by the widely spaced core supporting and positioning surfaces 58*a* and 58*b* shown in phantom lines in FIG. 6A at ends 51*a* and 51*b*, respectively, of intake core 50. The widely spaced core supporting portions 58*a* and 59*b* of intake core 50 are shown on the top view of core assembly 10 in FIG. 1A. As shown in FIG. 7, the long core element 60 may be placed from above in the upwardly facing core supporting and positioning surfaces 58*a* and 58*b* of core element 50.

Figure 9:
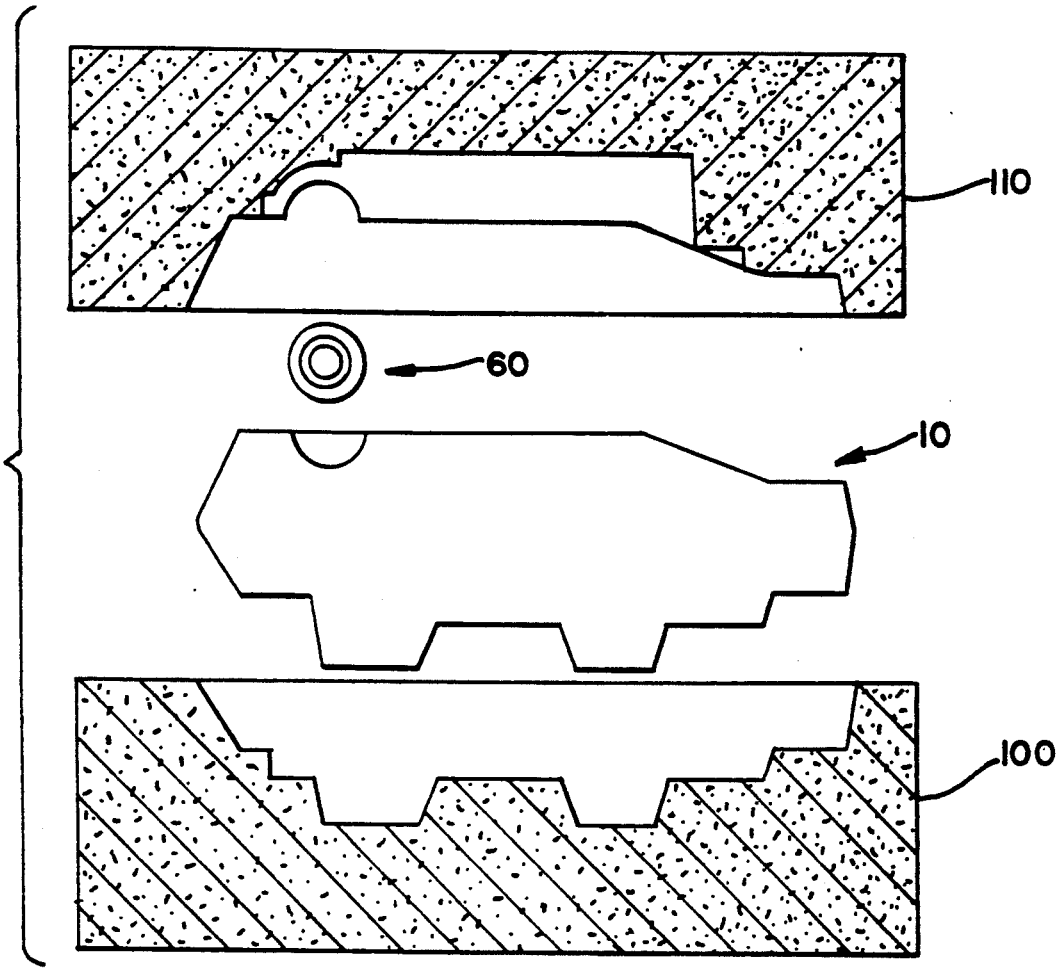
FIG. 9 is a diagrammatic, exploded, cross-sectional view of a mold and core assembly of this invention.
Figure 10:
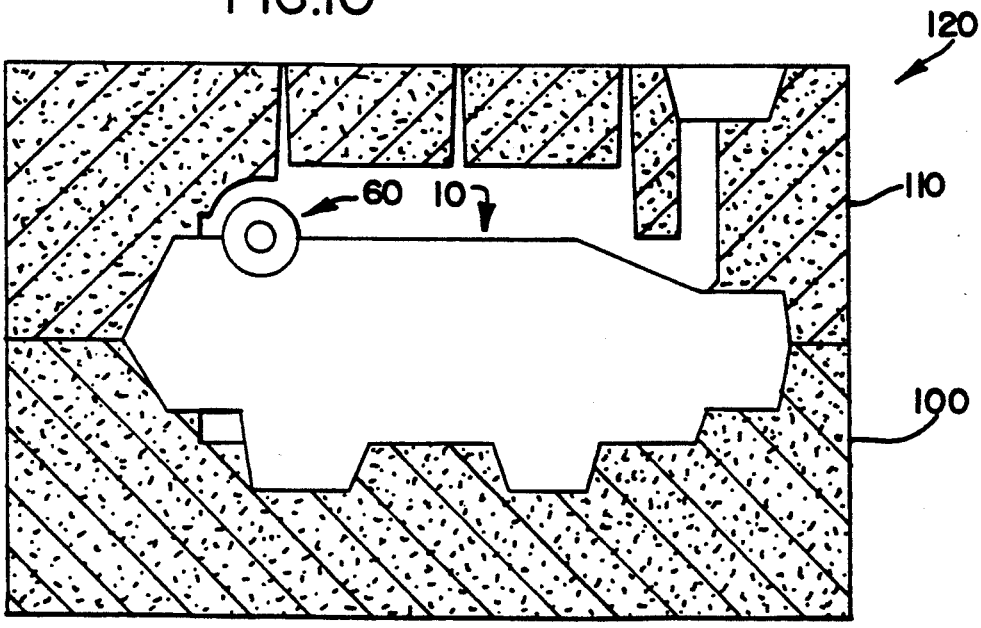
FIG. 10 is a diagrammatic cross-sectional view of a closed mold of this invention.

FIG. 9 indicates how the core assembly 10 of this invention is assembled into a mold for casting a cylinder head. The core assembly 10 is placed in a green sand lower mold half 100. The long core element 60 can then be placed on core assembly 10 or can have been previously placed on core assembly 10 as explained above. With the core assembly 10 and long core element 60 in position in the lower mold half 100, the upper mold half 110 is lowered into position to form a closed mold 120, as shown in FIG. 10.

Figure 11:
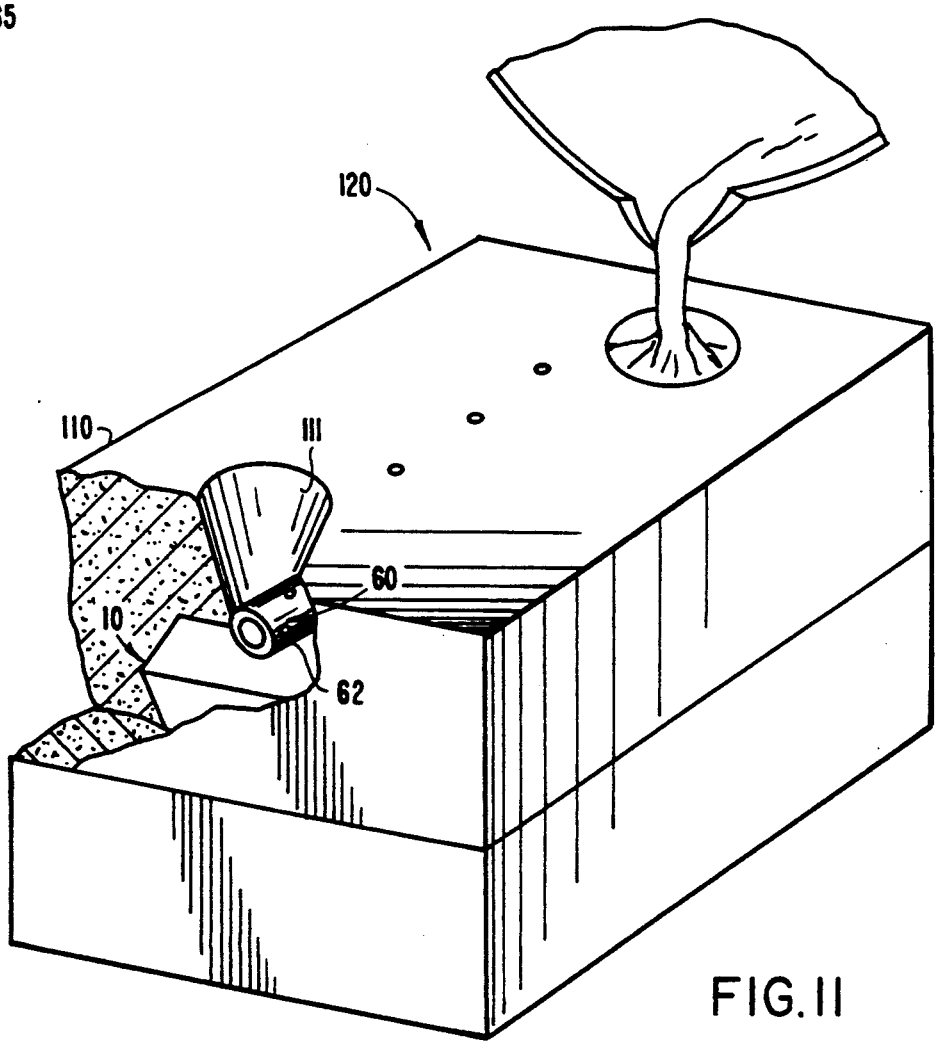
FIG. 11 is a diagrammatic perspective drawing to help illustrate a casting method of this invention.

FIG. 11 further illustrates the method of the invention by which an elongated, narrow open cavity is formed within a casting. FIG. 11 shows a closed mold 120 having a portion of the upper mold half 110 broken away to show the core assembly 10 and long core element 60 within the closed mold 120. As shown in FIG. 11, the upper mold half 110 is provided with a bore 111 which extends from adjacent end 62 of core element 60 to the atmosphere outside the mold. In the invention as casting metal is poured into the closed mold 120, water vapor and other gasses that may be emitted from the casting sand adjacent to, and the casting sand forming the long core element 60 can pass through the perforations 65 of the inner supporting element 64, travel through tube 64 to end 62 and escape to atmosphere through bore 111. Furthermore, inner supporting element 64 will support the long core element 60 as the mold 120 fills with casting metal and will prevent the deformation and breaking of long core element 60 during casting. The invention thus eliminates the need to include chaplets that might otherwise lie between element 60 and the walls within a closed mold to support the long, narrow core element and permits an elongated, narrow, open cavity to be formed by uniform walls of casting metal without the introduction of foreign supporting elements, such as chaplets. The long open cavity thus formed by the core element 60 is adapted for use as a relatively large reservoir of hydraulic fluid at high hydraulic pressures on the order of 3,000 p.s.i. and can reliably contain such high fluid pressures.

Figure 12:
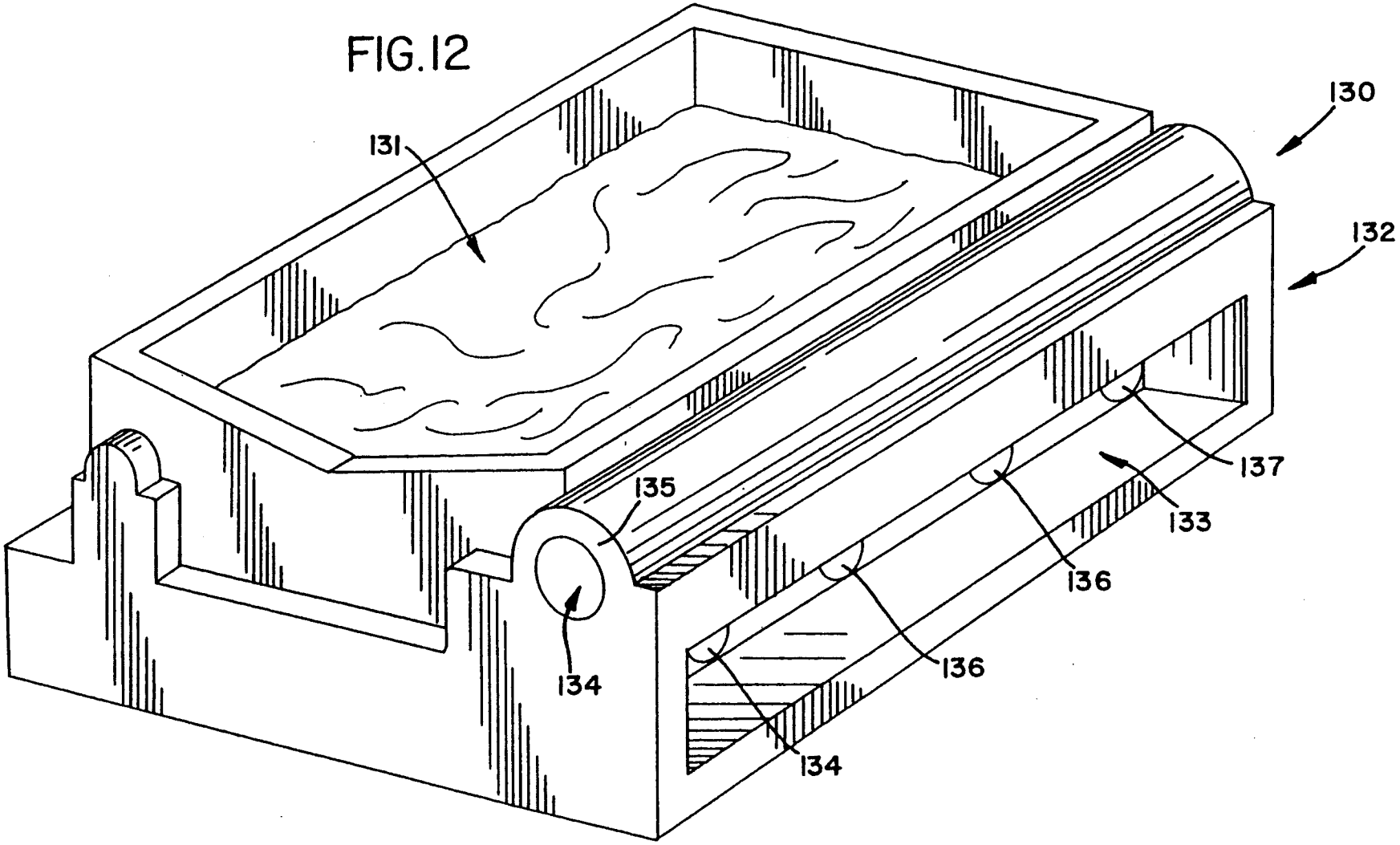
FIG. 12 is a cylinder head casting resulting from this invention.

FIG. 12 shows diagrammatically a cylinder head casting formed by the core casting methods and apparatus of this invention. As shown in FIG. 12, a cylinder head casting 130 of the invention includes a central cylinder block closing portion 131 which may be adapted to close and to provide fuel intake and exhaust from a plurality of cylinders formed in the block of an internal combustion engine. The cylinder head 130 is preferably formed with internal passageways by the core assembly 10 described above. The cylinder head 130 includes a side portion 132 that includes an air intake manifold cavity 133 that opens outwardly of the side portion and extends longitudinally in the cylinder head casting in between a plurality of passageways 134–137 extending transversely inwardly to adjacent the cylinder head closing portions of the casting. The air intake manifold cavity 133 of FIG. 12 is formed, for example, by portion 57 of the intake core 50 in a preferred embodiment of the invention, shown in FIGS. 5A and 5C.

The cylinder head casting 130 may further include a long open cavity 134 extending longitudinally through the cylinder head casting 130 from end to end and formed by uninterrupted uniform walls 135 of casting metal. The long open cavity is formed, for example, by long core element 60 of core assembly 10 as shown and described above. Such a long open cavity can provide a reservoir for hydraulic fluid at pressures on the order of 3,000 psi for operation of hydraulically-operated fuel injectors provided in cylinder head casting 130.

The invention thus provides a one-piece cylinder head casting including a reliably located passageways for fuel intake, air intake, for exhaust and for coolant and further provides an integral air intake manifold and an elongated cavity to provide a reliable reservoir for high pressure hydraulic fluid. In the invention, the plurality of interengaging one-piece core elements are reliably positioned and maintained in position to form the cylinder head with reliable strong walls and minimal metal content for its operating requirements.

Although preferred embodiments have been described above, it should be recognized that the invention may take other specific forms, and the invention is limited only insofar as is required by the scope of the prior art and following claims.

What is claimed is:

1. A method of forming an elongated, narrow open cavity within a cylinder head casting, comprising providing a closed mold or a cylinder head having two widely spaced wall portions, at least one of said widely spaced wall portions being in communication with the atmosphere through an opening in the closed mold, said widely spaced wall portions defining the ends of a long open cavity within the mold and providing core supporting portions for a long, narrow core element adapted to form an elongated, narrow open cavity within the casting;

providing a long, narrow core element extending between the core supporting portions of widely spaced wall portions of the mold without intervening support, said long, narrow core element comprising an outer portion of casting sand adapted to form the walls of the elongated, narrow open cavity of the casting extending between said core supporting portions and further comprising an inner portion for supporting said long, narrow core element and for providing gas passage extending to said one wall portion; and pouring molten metal into the closed mold and the long open mold cavity while permitting as emitted from the casting sand to escape to the atmosphere by carrying the gas to the atmosphere with said inner portion of said long, narrow core element and the opening in the closed mold.

2. The method of claim 1 wherein said inner portion of said long, narrow core element comprises a perforated tube.

3. The method of claim 1 wherein said inner portion of said long, narrow core element comprises a rod with a spiral groove on its outer surface.

4. A closed mold assembly for casting an internal combustion engine cylinder head, comprising:

a first mold portion and a second mold portion, said first and second mold portions having internal cavity portions for forming, at least in part, a cavity for the surfaces at an internal combustion engine cylinder head and further having two widely spaced wall portions within the cavity with core supporting portions; and a long, narrow mold element for casting a long, narrow open cavity without the use of mold element supports, comprising end portions shaped to engage and be supported by said core supporting portions of the widely spaced wall portions, a long inner portion adapted to support said long, narrow mold element, and an outer portion of casting sand surrounding said inner portion and adapted to form the walls of the long, narrow open cavity, said inner portion providing means for transmitting gas released in the long, narrow open cavity during casting to adjacent end portions, said first mold portion having an opening to the atmosphere for the release of said gas.

* * * * *